US010487273B2

(12) United States Patent
De Wet

(10) Patent No.: US 10,487,273 B2
(45) Date of Patent: Nov. 26, 2019

(54) PRODUCTION OF OILFIELD HYDROCARBONS

(71) Applicant: Sasol Technology Proprietary Limited, Sandton (ZA)

(72) Inventor: Ewald Watermeyer De Wet, Vanderbijlpark (ZA)

(73) Assignee: Sasol Technology Proprietary Limited, Sandton (ZA)

( * ) Notice: Subject to any disclaimer, the term of this patent is extended or adjusted under 35 U.S.C. 154(b) by 0 days.

(21) Appl. No.: 16/255,308

(22) Filed: Jan. 23, 2019

(65) Prior Publication Data

US 2019/0153339 A1 May 23, 2019

Related U.S. Application Data

(62) Division of application No. 15/329,756, filed as application No. PCT/ZA2015/050002 on Jul. 22, 2015, now Pat. No. 10,190,063.

(30) Foreign Application Priority Data

Jul. 28, 2014 (ZA) ..... 201405559

(51) Int. Cl.
*C10G 47/00* (2006.01)
*C10G 47/02* (2006.01)
(Continued)

(52) U.S. Cl.
CPC ..... *C10G 57/00* (2013.01); *C10G 47/00* (2013.01); *C10G 57/02* (2013.01); *C10G 65/00* (2013.01); *C10G 65/12* (2013.01); *C10G 65/14* (2013.01); *C10G 2300/1022* (2013.01)

(58) Field of Classification Search
CPC .... C07C 5/22; C07C 5/27; C07C 4/02; C10G 47/00; C10G 47/02; C10G 65/14
(Continued)

(56) References Cited

U.S. PATENT DOCUMENTS 2,678,263 A 5/1964 Glazier
5,965,783 A 10/1999 Gee et al.
(Continued)

FOREIGN PATENT DOCUMENTS

EP 0321305 6/1989
EP 0382804 6/1993
(Continued)

OTHER PUBLICATIONS

International Patent Application No. PCT/ZA2015/050002, Search Report and Written Opinion, dated Aug. 5, 2016.
(Continued)

*Primary Examiner* — Thuan D Dang
(74) *Attorney, Agent, or Firm* — Kilpatrick Townsend & Stockton LLP; Dean W. Russell

(57) ABSTRACT

A process to produce olefinic products suitable for use as or conversion to oilfield hydrocarbons includes separating an olefins-containing Fischer-Tropsch condensate into a light fraction, an intermediate fraction and a heavy fraction, oligomerising at least a portion of the light fraction to produce a first olefinic product which includes branched internal olefins, and carrying out either one or both of the steps of (i) dehydrogenating at least a portion of the intermediate fraction to produce an intermediate product which includes internal olefins and alpha-olefins, and synthesising higher olefins from the intermediate product which includes internal olefins and alpha-olefins to produce a second olefinic product, and (ii) dimerising at least a portion of the intermediate fraction to produce a second olefinic product. At least a portion of the heavy fraction is dehydrogenated to produce a third olefinic product which includes internal olefins. Also provided is a process to produce paraffinic products suitable for use as or conversion to oilfield hydrocarbons which includes separating a Fischer-Tropsch wax
(Continued)

into at least a lighter fraction and a heavier fraction, hydrocracking the heavier fraction to provide a cracked intermediate, and separating the cracked intermediate into at least a naphtha fraction, a heavier than naphtha paraffinic distillate fraction suitable for use as or conversion to oilfield hydrocarbons, and a bottoms fraction which is heavier than the paraffinic distillate fraction.

14 Claims, 2 Drawing Sheets

(51) Int. Cl.

| | |
|---|---|
| ***C10G 65/14*** | (2006.01) |
| ***C10G 57/00*** | (2006.01) |
| ***C10G 57/02*** | (2006.01) |
| ***C10G 65/00*** | (2006.01) |
| ***C10G 65/12*** | (2006.01) |

(58) Field of Classification Search
USPC ..... 585/300, 304, 734, 752; 208/20, 24, 78, 208/79, 80, 92, 108
See application file for complete search history.

(56) References Cited

U.S. PATENT DOCUMENTS

| | | | |
|---|---|---|---|
| 7,524,787 | B2 | 4/2009 | Visagie et al. |
| 8,318,003 | B2 | 11/2012 | Knottenbelt et al. |
| 8,513,312 | B2 | 8/2013 | Huyser et al. |
| 2001/0004972 | A1 | 6/2001 | Miller et al. |
| 2005/0205462 | A1 | 9/2005 | Gopalakrishnan et al. |
| 2006/0016722 | A1 | 1/2006 | Espinoza et al. |
| 2011/0024328 | A1 | 2/2011 | Virdi et al. |
| 2011/0036753 | A1* | 2/2011 | Tasaka ..... C10G 2/30 208/88 |
| 2011/0180455 | A1 | 7/2011 | Bouchy et al. |

FOREIGN PATENT DOCUMENTS

| | | |
|---|---|---|
| EP | 1449906 | 8/2004 |
| EP | 1618081 | 1/2008 |
| EP | 1421157 | 8/2012 |
| GB | 2158090 | 11/1985 |
| WO | 1999055646 | 11/1999 |
| WO | 2000020535 | 4/2000 |
| WO | 2001046340 | 6/2001 |
| WO | 2006067174 | 6/2006 |

OTHER PUBLICATIONS

International Patent Application No. PCT/ZA2015/050002, International Preliminary Report on Patentability, dated Jun. 14, 2017.
*U.S. Appl. No. 15/329,756, Restriction Requirement, dated Jul. 9, 2018.
*U.S. Appl. No. 15/329,756, Notice of Allowance, dated Oct. 24, 2018.

* cited by examiner

PRODUCTION OF OILFIELD HYDROCARBONS

CROSS REFERENCE TO RELATED APPLICATIONS

This application is a division of U.S. patent application Ser. No. 15/329,756, filed Jan. 27, 2017, which application is a U.S. national stage application under 35 U.S.C. § 371 of International Patent Application No. PCT/ZA2015/050002, filed Jul. 22, 2015, which claims priority to South African Patent Application No. 2014/05559, filed Jul. 28, 2014, all of which applications are incorporated herein in their entireties.

FIELD OF THE INVENTION

THIS INVENTION relates to production of oilfield hydrocarbons. In particular, the invention relates to a process to produce olefinic products suitable for use as or conversion to oilfield hydrocarbons and to a process to produce paraffinic products suitable for use as or conversion to oilfield hydrocarbons.

BACKGROUND

Crude oil will still be a major source of transportation energy in the years to come and will not be easily phased out by the recent shale gas boom largely due to the ever increasing demand for fuel, the lack of sufficient infrastructure and the time and cost associated to convert filling stations to be solely gas operated. Gas is currently quite extensively used as heating means across the world and may in future also become more popular as electricity generating means via gas turbines with a lower carbon dioxide footprint than when burning coal, rather than solely be used as a fuel or fuel pre-cursor. This means that the recovery of oil from oil deposits will remain and possibly even become an even more important activity for many years to come.

When using primary and secondary petroleum recovery techniques only around 50% of crude oil in wells can be recovered. During high oil price cycles it pays to explore tertiary recovery methods through the use of chemical surfactants to flood dormant or new wells. This recovery technique is also called enhanced oil recovery (EOR). Together with the need for EOR chemicals in potentially large volumes comes the need for oilfield solvents or drilling fluids. Together, these solvents, drilling fluids and the like are often referred to as oilfield hydrocarbons.

Oilfield hydrocarbons, as well as lubricant base oils, may provide attractive profit margins over fuels if they can be sourced from one single production facility. Such a production facility may advantageously be a Fischer-Tropsch synthesis plant with the required oilfield hydrocarbon molecules and/or base oil molecules present in product streams emanating from a Fischer-Tropsch hydrocarbon synthesis reactor. Typically however, a Fischer-Tropsch plant with its downstream work-up facilities is not configured for production of oilfield hydrocarbons, or for optimised production of lubricant base oils, but rather for production of fuel such as diesel and petrol (gasoline).

EOR chemicals or surfactant feedstock are typically olefins and are those hydrocarbons, once fully functionalized, that get used for the exploration and/or recovery of oil and gas from underground reservoirs. Oilfield solvents are either paraffins or olefins that are used in on-shore or off-shore drilling applications.

The most versatile source of hydrocarbon feedstock for EOR surfactants or chemicals is thus olefins. Olefins are more reactive than paraffins and can therefore be the ideal pre-cursor for alcohols (through e.g. hydroformylation) and alkyl or di-alkyl aromatics (through e.g. alkylation) which can either undergo alkoxylation, sulfation and/or sulfonation to be finally used as linear and/or branched surfactants in EOR applications. An olefin feedstock can also be directly sulfonated to be used in EOR applications either as internal olefin sulfonate or alpha olefin sulfonate. The sources of hydrocarbon feedstock for oilfield solvents and more specifically oil-based drilling fluids are either paraffins or olefins and more preferably a mixture of linear and branched paraffins or internal olefins.

The carbon ranges for oilfield hydrocarbons can vary depending on whether paraffins or olefins are to be used in the various applications. When paraffins and/or olefins are used as a drilling fluid the carbon range could be between $C_{12}$-$C_{22}$. Where olefins are used for alkylation to produce alkyl aromatics the carbon range could be $C_{10}$-$C_{24}$ and when olefins are used as is or as an alcohol pre-cursor the carbon range could be $C_{16}$-$C_{30}$. When the paraffins are used as lubricant base oil the carbon range could be between $C_{18}$-$C_{55}$.

SUMMARY

According to a first aspect of the invention, there is provided a process to produce olefinic products suitable for use as or conversion to oilfield hydrocarbons, the process including separating an olefins-containing Fischer-Tropsch condensate into a light fraction, an intermediate fraction and a heavy fraction;

oligomerising at least a portion of the light fraction to produce a first olefinic product which includes branched internal olefins;

carrying out either one or both of the steps of:

(i) dehydrogenating at least a portion of the intermediate fraction to produce an intermediate product which includes internal olefins and alpha-olefins, and synthesising higher olefins from the intermediate product which includes internal olefins and alpha-olefins to produce a second olefinic product; and (ii) dimerising at least a portion of the intermediate fraction to produce a second olefinic product; and dehydrogenating at least a portion of the heavy fraction to produce a third olefinic product which includes internal olefins.

The olefins-containing Fischer-Tropsch condensate may be a $C_5$-$C_{22}$ Fischer-Tropsch condensate product or stream.

Separating an olefins-containing Fischer-Tropsch condensate into a light fraction, an intermediate fraction and a heavy fraction typically includes distilling the olefins-containing Fischer-Tropsch condensate.

At least 95% by mass of molecules making up the light fraction may boil between −30° C. and 100° C.

The light fraction may be a $C_5$-$C_7$ fraction.

At least 95% by mass of molecules making up the intermediate fraction may boil between 110° C. and 270° C.

The intermediate fraction may be a $C_8$-$C_{15}$ fraction.

At least 95% by mass of molecules making up the heavy fraction may boil between 280° C. and 370° C.

The heavy fraction may be a $C_{16}$-$C_{22}$ fraction.

The process may include combining a $C_3$ and/or $C_4$ fraction which is gaseous under ambient conditions with the light fraction prior to oligomerising the light fraction. This paraffinic and/or olefinic fraction could also be called liquefied petroleum gas (LPG).

Oligomerising the light fraction may provide said first olefinic product which includes branched internal olefins in the range of $C_9$-$C_{22}$. Oligomerising the light fraction may include using a zeolitic catalyst, e.g. a zeolitic catalyst as described in U.S. Pat. No. 8,318,003 or EP 382804 B1. As will be appreciated by those skilled in the art, choosing optimised oligomerisation process conditions is important in order to inhibit cyclo-paraffin and aromatic production and to promote production of branched internal olefins. These process conditions typically include a lower average catalyst activity and a lower pressure, typically less than 15 bar, compared to 50-80 bar as described in U.S. Pat. No. 8,318,003.

The process may include fractionating the first olefinic product into a $C_9$-$C_{15}$ fraction and a $C_{15}^+$ fraction. The $C_9$-$C_{15}$ fraction may be converted in an aromatic alkylation unit to produce branched di-alkylates. For example, $2\times C_{10}$ olefins will produce a $C_{26}$ di-alkylate.

Instead, and when the intermediate fraction is subjected to the dehydrogenation and higher olefin synthesis (step (i) above), the $C_9$-$C_{15}$ fraction may be combined with the intermediate product which includes internal and alpha-olefins resulting from the dehydrogenation of the intermediate fraction, to be synthesised into higher olefins thereby to form part of the second olefinic product.

Commercially available technology, such as UOP's PACOL™ technology, may be used to dehydrogenate the intermediate fraction. UOP's commercial OLEX™ technology may also be used to first separate the alpha olefins from the paraffins of the intermediate fraction before dehydrogenation of the paraffins. During the dehydrogenation step internal olefins are produced so that, when these are then combined with the separated out alpha olefins, the intermediate product comprising the mixture of internal and alpha olefins, is formed.

Synthesising of higher olefins from the intermediate product which includes internal olefins and alpha-olefins may be effected by means of dimerisation or olefin metathesis.

Alternatively, when the intermediate fraction is subjected to the dimerisation step (ii) above, the $C_9$-$C_{15}$ fraction may be combined with the intermediate fraction so that it is also subjected to dimerisation and hence forms part of the second olefinic product.

The dimerisation may be effected in the presence of a dimerisation catalyst. Suitable dimerisation catalysts are, for example, described in WO 99/55646 and in EP 1618081 B1.

The second olefinic product may be a $C_{16}$-$C_{30}$ mixture of vinylidenes and/or internal olefins.

The first olefinic product and the second olefinic product may be such that a combination of the first olefinic product and the second olefinic product provides an olefinic product with at least 50% by mass of hydrocarbons having carbon chain lengths of between 15 and 30 carbon atoms per molecule, or in which a combination of the first olefinic product and the second olefinic product provides an olefinic product with at least 90% by mass of hydrocarbons having carbon chain lengths of between 15 and 30 carbon atoms per molecule and having at least 0.5 branches per molecule on average.

The process may include using the second olefinic product to alkylate aromatics. Instead, the process may include hydroformylating and alkoxylating the second olefinic product to produce linear and branched oilfield hydrocarbon pre-cursor molecules.

Commercially available technology, such as the aforementioned UOP PACOL™ technology, may be used to dehydrogenate the heavier fraction. The heavier fraction may also be treated in an OLEX™ unit to separate alpha olefins from paraffins and then dehydrogenating only the resultant paraffin fraction; however, the olefin content in this heavier fraction may be low enough not to warrant the need for this additional step.

The process may include using the third olefinic product to alkylate aromatics. Instead, the process may include hydroformylating and alkoxylating the third olefinic product to produce linear and branched oilfield hydrocarbon precursor molecules.

The process may include using the $C_{15}^+$ fraction from the first olefinic product to alkylate aromatics. Instead, the process may include hydroformylating and alkoxylating the $C_{15}^+$ fraction from the first olefinic product to produce linear and branched oilfield hydrocarbon pre-cursor molecules.

Typically, Fischer-Tropsch condensate includes unwanted oxygenates that may deactivate some of the catalyst used downstream in the process of the invention. The process may thus include dehydrating the olefins-containing Fischer-Trospch condensate to convert oxygenated hydrocarbons to alpha-olefins. This will typically take place prior to separating the olefins-containing Fischer-Tropsch condensate into said light fraction, intermediate fraction and heavy fraction.

Typically, the oxygenates are mostly primary alcohols and can be dehydrated using an alumina catalyst. Alternatively, the oxygenates may be recovered from the olefins-containing Fischer-Tropsch condensate using methanol liquid extraction, but this approach will reduce the production of desired olefins.

Preferably, the olefins-containing Fischer-Tropsch condensate includes at least 50% by mass olefins. The balance may be predominantly paraffins. The olefins-containing Fischer-Tropsch condensate is a liquid under ambient conditions. The olefins-containing Fischer-Tropsch condensate may be obtained from a Fe or a Co-based catalytic Fischer-Tropsch process. Preferably, the olefins-containing Fischer-Tropsch condensate is however obtained from a Fe-based catalytic Fischer-Tropsch process.

The process may thus include subjecting synthesis gas to Fischer-Tropsch synthesis in a Fischer-Tropsch synthesis stage to produce said olefins-containing Fischer-Tropsch condensate. Said Fischer-Tropsch synthesis in said Fischer-Tropsch synthesis stage may also provide said liquefied petroleum gas.

According to a second aspect of the invention, there is provided a process to produce paraffinic products suitable for use as or conversion to oilfield hydrocarbons, the process including separating a Fischer-Tropsch wax into at least a lighter fraction and a heavier fraction;

hydrocracking the heavier fraction to provide a cracked intermediate; and separating the cracked intermediate into at least a naphtha fraction, a heavier than naphtha paraffinic distillate fraction suitable for use as or conversion to oilfield hydrocarbons, and a bottoms fraction which is heavier than the paraffinic distillate fraction.

Typically, the cracked intermediate is separated also into a light or LPG fraction which is lighter than the naphtha fraction.

If desired, the process may include hydrotreating the heavier fraction obtained from the Fischer-Tropsch wax before the heavier fraction is hydro cracked.

Preferably at least 50% by mass of the heavier than naphtha paraffinic distillate fraction is made up of hydrocarbons having carbon chain lengths of between 12 and 22 carbon atoms per molecule, more preferably at least 75% by mass of the heavier than naphtha paraffinic distillate fraction is made up of hydrocarbons having carbon chain lengths of between 12 and 22 carbon atoms per molecule and having at least 0.5 branches per molecule on average, most preferably at least 90% by mass of the heavier than naphtha paraffinic distillate fraction is made up of hydrocarbons having carbon chain lengths of between 12 and 22 carbon atoms per molecule and having at least 0.5 branches per molecule on average.

At least 95% by mass of molecules making up the paraffinic distillate fraction may boil between 200° C. and 370° C.

Preferably, the paraffinic distillate fraction is a $C_{12}$-$C_{22}$ fraction. The paraffinic distillate fraction may have a flash point above 60° C. When the cracked intermediate is separated in an atmospheric distillation column, this can easily be achieved by setting a bottom cut-off point for the distillate fraction at around $C_{12}$ or higher in the atmospheric distillation column.

Typically, the distillate fraction has a pour point of less than −15° C. As will be appreciated by those skilled in the art, with a flash point above 60° C. and a pour point less than −15° C., the distillate fraction is well suited for use as a synthetic paraffinic drilling fluid component, providing a better profit margin than diesel.

The paraffinic distillate fraction preferably has an i:n-paraffin ratio greater than 50% by mass. This can be achieved using a noble metal hydrocracking catalyst and hydrocracking at relatively high conversion said heavier fraction obtained from the Fischer-Tropsch wax. The noble metal catalyst may be supported on an amorphous $SiO_2$/$Al_2O_3$ support or on a Y-zeolite. The catalyst may have a $C_{12}$-$C_{22}$ selectivity of at least 75%.

The hydrocracking conditions may be such that at least 80% by mass of components of the heavier fraction boiling at 590° C. or more is converted or cracked to boil at less than 590° C., i.e. ≥80% by mass conversion of 590° C.+ components into 590° C.− components.

EP 142157 describes the use of noble metal hydrocracking catalysts at high conversion conditions.

If required that the paraffinic distillate fraction must have a pour point below −25° C., the process may include hydro-isomerising the paraffinic distillate fraction using a noble metal hydro-isomerisation catalyst. The hydro-isomerisation catalyst may thus be a noble metal catalyst on for example a SAPO-11, ZSM-22, ZSM-48, ZBM-30 or MCM-type support. Preferably, the hydro-isomerised paraffinic distillate fraction has an i:n-paraffin mass ratio greater than 2:1, with less than 1% by mass aromatics.

The process may include using the naphta fraction obtained from the cracked intermediate as diluent to improve pumpability of any high viscosity material produced in the process, or as feedstock to a stream cracker.

Typically, separating a Fischer-Tropsch wax into at least a lighter fraction and a heavier fraction includes separating the Fischer-Tropsch wax into a light fraction and an intermediate fraction and said heavier fraction.

The light fraction may be a $C_{15}$-$C_{22}$ light fraction.

The intermediate fraction may be a $C_{23}$-$C_{50}$ intermediate fraction.

The process may include hydrotreating the intermediate fraction using a hydrotreating catalyst to remove oxygenates or olefins that may be present. The hydrotreating catalyst may be any mono-functional commercially available catalyst, e.g. Ni on alumina.

The process may include hydro-isomerising the intermediate fraction, using a hydro-isomerisation catalyst to provide a hydro-isomerised intermediate product. The hydro-isomerisation catalyst may be a noble metal catalyst on a SAPO-11, ZSM-22, ZSM-48, ZBM-30 or MCM-type support.

The process may include separating the hydro-isomerised intermediate product into two or more base oil fractions. The process according to the second aspect of the invention may thus also be a process to produce lubricant base oils.

Preferably, the hydro-isomerised intermediate product is vacuum-distilled into at least a light grade base oil fraction, a medium grade base oil fraction and a heavy base oil fraction. A viscosity grade of each base oil fraction can be varied within limits according to market demand, depending on how side strippers on a vacuum distillation unit, used to separate the base oil fractions, are operated. The most preferred base oil fractions are the medium grade base oil fraction and the heavy base oil fraction, with kinematic viscosity grades respectively of about 4 centistokes and about 8 centistokes at 100° C. These synthetic lubricant base oil fractions have excellent viscosity indexes greater than 120 due to their highly paraffinic nature, very low pour point of less than −25° C. and Noack volatilities less than 12 for the medium grade base oil fraction.

Separating the hydro-isomerised intermediate product may include producing a naphta fraction and/or a $C_{12}$-$C_{22}$ distillate fraction, depending on the severity of the hydro-isomerisation process step. If a $C_{12}$-$C_{22}$ distillate fraction is produced, it may be joined with the cracked intermediate, or separated with the cracked intermediate, to provide additional paraffinic distillate fraction.

At least 95% by mass of molecules making up the bottoms fraction obtained from the cracked intermediate may boil above 370° C.

The bottoms fraction obtained from the cracked intermediate, which is typically a $C_{22}^{+}$ stream, may be recycled for hydrocracking with the heavier fraction obtained from the Fischer-Tropsch wax. Alternatively, and more preferred, the bottom fraction may be subjected to hydro-isomerisation together with the intermediate fraction obtained from the Fischer-Tropsch wax to increase valuable base oil production, bearing in mind that base oils provide an even better profit margin than an oilfield hydrocarbon such as a drilling fluid.

The process may include subjecting synthesis gas to Fischer-Tropsch synthesis in a Fischer-Tropsch synthesis stage to produce said Fischer-Tropsch wax.

The Fischer-Tropsch synthesis stage may employ at least one slurry reactor using a Fischer-Tropsch catalyst to convert synthesis gas to hydrocarbons. The catalyst may be Fe or a Co-based. Preferably, the catalyst is however a Fe-based catalyst.

Preferably, the Fischer-Tropsch synthesis stage, when employing a Fe-based catalyst, is operated at a temperature between about 200° C. and about 300° C., more preferably between about 230° C. and about 260° C., e.g. about 245° C.

Preferably, the Fischer-Tropsch synthesis stage, when employing a Fe-based catalyst, is operated at pressure between about 15 bar(a) and about 40 bar(a), e.g. about 21 bar(a).

Preferably, the Fischer-Tropsch synthesis stage, when employing a Fe-based catalyst, is operated with a synthesis gas $H_2$:CO molar ratio between about 0.7:1 and about 2:1, e.g. about 1.55:1.

Preferably, the Fischer-Tropsch synthesis stage, when employing a Fe-based catalyst, is operated with a wax alpha value of at least about 0.92, more preferably at least about 0.94, e.g. about 0.945.

Preferably, the Fischer-Tropsch synthesis stage, when employing a Co-based catalyst, is operated at a temperature between about 200° C. and about 300° C., more preferably between about 220° C. and about 240° C., e.g. about 230° C.

Preferably, the Fischer-Tropsch synthesis stage, when employing a Co-based catalyst, is operated at pressure between about 15 bar(a) and about 40 bar(a), e.g. about 25 bar(a).

Preferably, the Fischer-Tropsch synthesis stage, when employing a Co-based catalyst, is operated with a synthesis gas $H_2$:CO molar ratio between about 1.5:1 and about 2.5:1, e.g. about 2:1.

Preferably, the Fischer-Tropsch synthesis stage, when employing a Co-based catalyst, is operated with a wax alpha value of at least about 0.87, more preferably at least about 0.90, e.g. about 0.91.

In one embodiment of the invention, the process includes subjecting synthesis gas to Fischer-Tropsch synthesis in a Fischer-Tropsch synthesis stage to produce said Fischer-Tropsch wax, the Fischer-Tropsch synthesis stage employing at least one slurry reactor using an Fe-based Fischer-Tropsch catalyst to convert synthesis gas to hydrocarbons, the Fischer-Tropsch synthesis stage being operated at a temperature between 200° C. and 300° C. at a pressure between 15 bar(a) and 40 bar(a) with a synthesis gas $H_2$:CO molar ratio between 0.7:1 and 2:1 and with a wax alpha value of at least 0.92.

According to a third aspect of the invention there is provided a process to produce olefinic products suitable for use as or conversion to oilfield hydrocarbons and to produce paraffinic products suitable for use as or conversion to oilfield hydrocarbons, the process including a process according to the first aspect of the invention and a process according to the second aspect of the invention.

The process according to the third aspect of the invention may provide a total olefin yield of at least 25% by mass and a total paraffin yield of at least 25% by mass.

The process according to the third aspect of the invention may provide a total olefin yield in a carbon range of $C_{16}$-$C_{30}$ of at least 10% by mass and a total paraffin yield in a carbon range of $C_{12}$-$C_{22}$ of at least 10% by mass and a total paraffin yield in a carbon range of $C_{23}$-$C_{50}$ of at least 15% by mass. The paraffinic $C_{12}$-$C_{22}$ fraction is well suited for use or conversion to drilling fluids and the paraffinic $C_{22}$-$C_{50}$ fraction is well suited for use as lubricant base oils. The olefins fraction in the $C_{16}$-$C_{30}$ range is well suited for use or conversion to oilfield hydrocarbons such as oilfield solvents or EOR surfactants.

The process according to the third aspect of the invention may employ a Fischer-Tropsch synthesis stage as hereinbefore described and may provide paraffinic and olefinic products suitable for use as or conversion to oilfield hydrocarbons, and lubricant base oils, in a yield of at least 50% by mass, from said Fischer-Tropsch synthesis stage.

In the process according to the third aspect of the invention, the olefins in the olefins-containing Fischer-Tropsch condensate may make up at least 15% by mass of the total of the sum of the olefins-containing Fischer-Tropsch condensate and the Fischer-Tropsch wax and any liquefied petroleum gas.

The invention extends to the use of olefins-containing Fischer-Tropsch condensate in a process to produce olefinic products suitable for use as or conversion to oilfield hydrocarbons.

The invention further extends to the use of Fischer-Tropsch wax in a process to produce paraffinic products suitable for use as or conversion to oilfield hydrocarbons.

The use of Fischer-Tropsch wax in a process to produce paraffinic products suitable for use as or conversion to oilfield hydrocarbons may include the use of said wax to produce base oils.

The olefins-containing Fischer-Tropsch condensate and the Fischer-Tropsch wax may be obtained from a Fischer-Tropsch synthesis reaction conducted at a temperature between 200° C. and 300° C.

BRIEF DESCRIPTION OF THE DRAWINGS

The invention will now be described, by way of example, with reference to the accompanying diagrammatic drawings. In the drawings.

DETAILED DESCRIPTION

Figure 1:
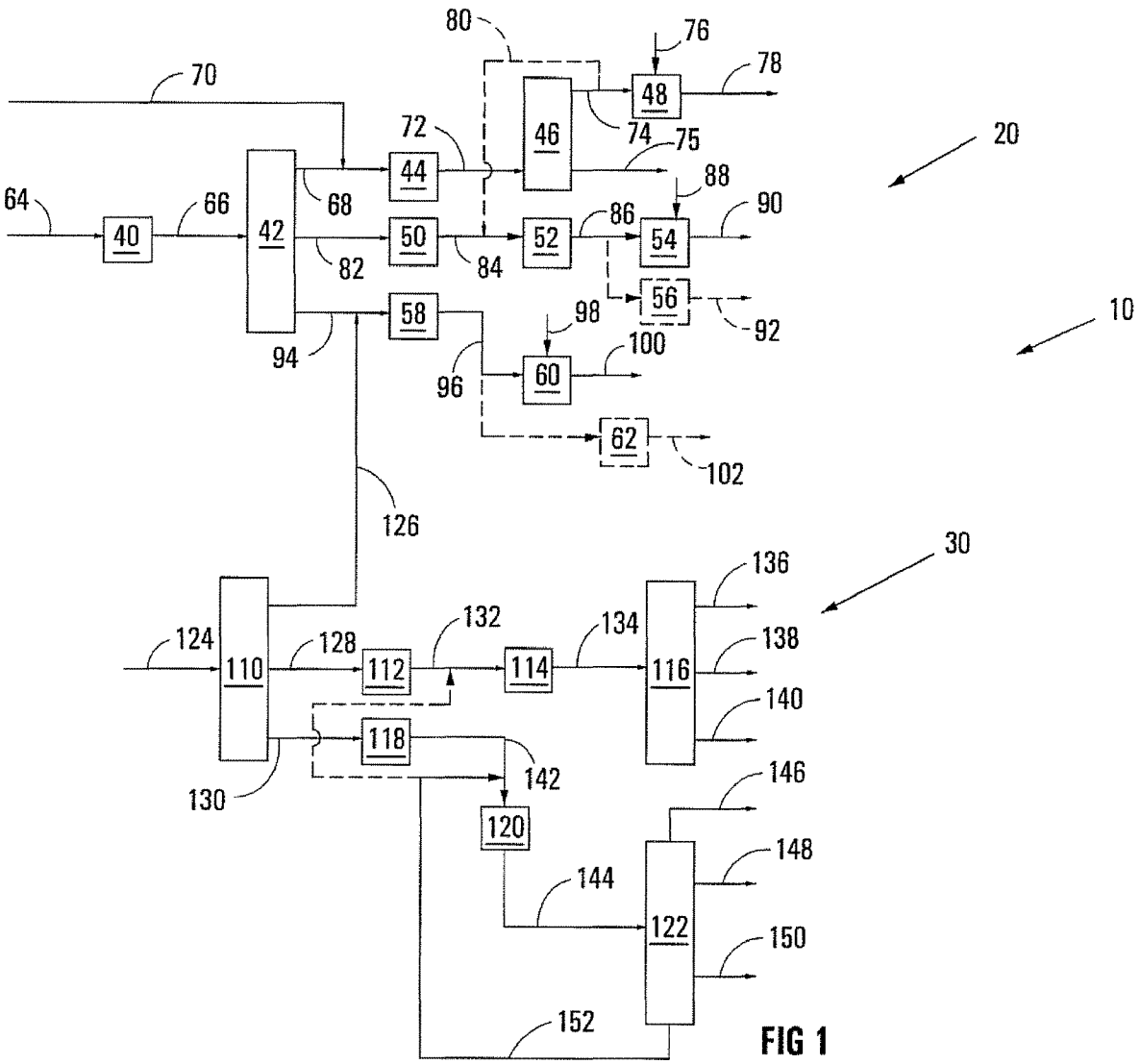
FIG. 1 shows a process in accordance with a first embodiment of the invention to produce olefinic products suitable for use as or conversion to oilfield hydrocarbons and to produce paraffinic products suitable for use as or conversion to oilfield hydrocarbons, together with base oils.

Referring to FIG. 1, reference numeral 10 generally shows a process in accordance with a first embodiment of the invention to produce olefinic products suitable for use as or conversion to oilfield hydrocarbons and to produce paraffinic products suitable for use as or conversion to oilfield hydrocarbons, as well as base oils. The process 10 is a combination of a process 20 in accordance with the invention to produce olefinic products from a Fischer-Tropsch condensate, and a process 30 in accordance with the invention to produce paraffinic products (and base oils) from a Fischer-Tropsch wax.

The process 20 includes a dehydration stage 40, a distillation column 42, an oligomerisation stage 44, a distillation column 46, an aromatic alkylation unit 48, a dehydrogenation stage 50, a dimerisation stage 52, an aromatic alkylation stage 54 or an optional hydroformylation and alkoxylation stage 56, a dehydrogenation stage 58, an aromatic alkylation stage 60 and an optional hydroformylation and alkoxylation stage 62.

In the process 20, an olefins-containing Fischer-Tropsch condensate is fed by means of a line 64 to the dehydration stage 40. The olefins-containing Fischer-Tropsch condensate is obtained from a Fischer-Tropsch synthesis stage in which synthesis gas is subjected to Fischer-Tropsch synthesis in the presence of a Fischer-Tropsch catalyst to produce a slate of hydrocarbons and by-products such as oxygenates. The Fischer-Tropsch catalyst can be either a cobalt-based catalyst or an iron-based catalyst, although an iron-based catalyst is preferred. U.S. Pat. Nos. 7,524,787 and 8,513,312 teach preparation of Co and Fe catalysts that can be used in said Fischer-Tropsch synthesis stage. Table 1 shows suitable or even preferred operating conditions for such a Fischer-Tropsch synthesis stage for both cobalt-based catalysts and iron-based catalysts.

TABLE 1

| Operating conditions | | |
|---|---|---|
| Catalyst | $Co/Pt/Al_2O_3$ | Precipitated Fe |
| Temperature | 230° C. | 245° C. |
| Pressure | 25 bar | 21 bar |
| Syngas molar $H_2$:CO ratio | 2:1 | 1.55:1 |
| Wax alpha value | 0.91 | 0.945 |

Table 2 shows typical product slates for such a Fischer-Tropsch synthesis stage using cobalt-based catalysts or iron-based catalysts. As will be appreciated by those skilled in the art, depending on the type of Fischer-Tropsch catalyst used, the temperature and $H_2$:CO syngas molar ratio, the hydrocarbon species of a syncrude produced by Fischer-Tropsch synthesis could be varied between predominantly paraffins or fairly substantial quantities of olefins, the bulk of these olefins typically appearing in the liquid condensate fraction (>30% by mass). When Fischer-Tropsch syncrude is derived from a low to medium temperature Fe-based Fischer-Tropsch catalytic process (200° C.-300° C. with the bulk of the syncrude being in the liquid phase under reaction conditions) the resulting olefin content in condensate syncrude typically exceeds more than 15% by mass of total syncrude.

Most of the $C_3$-$C_{22}$ hydrocarbons shown in Table 2 form part of the olefins-containing Fischer-Tropsch condensate, although some of the $C_3$ and $C_4$ hydrocarbons will be produced by the Fischer-Tropsch synthesis stage in the form of a gas which can be liquefied to form liquefied petroleum gas (LPG). The olefins-containing Fischer-Tropsch condensate thus typically is made up of $C_5$-$C_{22}$ hydrocarbons and some oxygenates (2-10% by mass).

TABLE 2

| Fischer-Tropsch Syncrude Composition (based on total mass %) | | |
|---|---|---|
| Fischer-Tropsch Process | Co Low Temperature Fischer-Tropsch Catalyst | Fe Low Temperature Fischer-Tropsch Catalyst |
| $C_3$-$C_7$ Olefins (incl. LPG) | 7 | 10 |
| $C_8$-$C_{15}$ Olefins | 5 | 10 |
| $C_8$-$C_{15}$ Paraffins | 24 | 10 |
| $C_{16}$-$C_{22}$ Paraffins | 8 | 6 |
| Condensate Oxygenates | 5-10 | 5-10 |
| $C_{22}$-$C_{50}$ waxy paraffins | 35 | 35 |
| $C_{50}$+ waxy paraffins | 9 | 15 |

The olefins-containing Fischer-Tropsch condensate is thus recovered from the top of a Fischer-Tropsch slurry reactor operating at a temperature in the range of 200° C. to 300° C. in conventional fashion and is a liquid under ambient conditions. As can be seen from Table 2, the olefins-containing Fischer-Tropsch condensate includes some unwanted oxygenates that may potentially deactivate catalysts used in downstream process units. The olefins-containing Fischer-Tropsch condensate is thus dehydrated in the dehydration stage 40 to convert the oxygenated hydrocarbons, comprising mostly of primary alcohols, to alpha olefins, typically using an alumina catalyst. Alternatively, these oxygenates can be recovered from the olefins-containing Fischer-Tropsch condensate by means of a methanol liquid extraction unit (not shown). This will however be at the expense of the production of olefins.

Once dehydrated, the olefins-containing Fischer-Tropsch condensate, which also includes a significant proportion of paraffins as can be seen in Table 2, is fed to the distillation column 42 by means of a flow line 66.

In the distillation column 42, the olefins-containing Fischer-Tropsch condensate is separated into a light $C_5$-$C_7$ fraction, an intermediate $C_8$-$C_{15}$ fraction and a heavy $C_{16}$-$C_{22}$ fraction. The $C_5$-$C_7$ light fraction is withdrawn by means of a flow line 68 and combined with liquefied petroleum gas from the Fischer-Tropsch synthesis stage which is fed by means of a flow line 70. The light $C_5$-$C_7$ fraction, together with the liquefied petroleum gas, is oligomerised in the oligomerisation stage 44, using a zeolitic catalyst, producing a first olefinic product which includes branched internal olefins in the distillate boiling range $C_9$-$C_{22}$. Examples of preferred zeolitic catalysts can be found in U.S. Pat. No. 8,318,003 and EP 38280461. The first olefinic product is withdrawn by means of the flow line 72 and fractionated in the distillation column 46 into a $C_9$-$C_{15}$ olefin stream and a $C_{15}^+$ olefin stream. The $C_9$-$C_{15}$ olefin stream is withdrawn from the distillation column 46 by means of a flow line 74 and is used in the aromatic alkylation stage 48 to alkylate aromatics from a flow line 76 to produce branched dialkylates, which is withdrawn by means of a flow line 78. The $C_{15}^+$ olefin stream is withdrawn from the distillation column 46 along a flow line 75. Alternatively, the $C_9$-$C_{15}$ olefins from the distillation column 46 or a portion thereof can be dimerised in the dimerisation stage 52, as shown by the optional flow line 80, to produce $C_{18}$-$C_{30}$ branched olefins.

The $C_8$-$C_{15}$ intermediate fraction from the distillation column 42 is fed by means of a flow line 82 to the dehydrogenation stage 50 where the $C_8$-$C_{15}$ intermediate fraction is dehydrogenated using commercially available technology, such as UOP's PACOL™ technology, to produce internal olefins. Optionally, i.e. if required, the alpha olefins can be separated (not shown) from the paraffins, e.g. in a UOP OLEX™ unit, with only the resultant paraffin fraction then passing to the dehydrogenation stage 50. A mixture of internal and alpha olefins is fed via a flow line 84 and is dimerised in the dimerisation stage 52 using a suitable dimerisation catalyst, e.g. as described in WO 99/55646 and/or EP 161808161. A second olefinic product, which is typically a mixture of $C_{16}$-$C_{30}$ vinylidenes and internal olefins, is withdrawn from the dimerisation stage 52 by means of a flow line 86. The second olefinic product can either be used to alkylate aromatics from a flow line 88 in the aromatic alkylation stage 54 to produce branched monoalkylates which are withdrawn by means of a flow line 90, or can more preferably be hydroformylated and alkoxylated as shown by the optional hydroformylation and alkoxylation stage 56 to produce various linear and branched oilfield pre-cursor molecules withdrawn by means of a flow line 92.

The heavy $C_{16}$-$C_{22}$ fraction from the distillation column 42 is withdrawn by means of a flow line 94 and dehydrogenated in the dehydrogenation stage 58, for example again using UOP's PACOL™ technology, to produce a third olefinic product which includes internal olefins. The third olefinic product is withdrawn from the dehydrogenation stage 58 by means of a flow line 96. The third olefinic product can also be used to alkylate aromatics provided by means of a flow line 98 to the aromatic alkylation unit 60 thereby to produce branched mono-alkylates which are withdrawn by means of a flow line 100, or be hydroformylated and alkoxylated in the hydroformylation and alkoxylation stage 62 to produce linear and branched oilfield pre-cursor molecules withdrawn by means of a flow line 102.

As will be appreciated, in the process 20, olefins from a Fischer-Tropsch condensate have through various chemical transformation steps been upgraded to higher molecular weight olefins of high value. These higher molecular weight olefins can be used as EOR surfactant feedstock or drilling fluids in the $C_{16}$-$C_{30}$ carbon range.

The process 30 includes a vacuum distillation column 110, a hydro-treating stage 112, a hydro-isomerisation stage 114, a vacuum distillation column 116, a hydro-treating stage 118, which may be optional, a hydro-cracking stage 120 and an atmospheric distillation column 122.

Fischer-Tropsch wax from the Fischer-Tropsch synthesis stage (not shown), mainly made up of linear paraffins in the $C_{15}$ to $C_{105}$, or as high as $C_{120}$ carbon range depending on the Fischer-Tropsch catalyst used and the subsequent alpha value obtained, and thus including $C_{22}$-$C_{50}$ waxy paraffins and $C_{50}^{+}$ waxy paraffins as shown in Table 2, is fed by means of a flow line 124 to the vacuum distillation column 110. If the Fischer-Tropsch synthesis stage employs a cobalt-based catalyst, the waxy paraffins may range from about up $C_{15}$ to about $C_{80}$ and may have an alpha value of about 0.91. If the Fischer-Tropsch synthesis stage however employs an iron-based catalyst, the waxy paraffins can include up to about $C_{120}$ hydrocarbons. Traditionally Low Temperature Fischer-Tropsch Co waxes were hydrocracked to maximise fuel type products e.g. diesel, kerosene and naphtha with lubricant base oils being a potential by-product from the heavier bottoms of the hydrocracker. However, shifting to higher alpha value (0.945) waxes e.g. Fe wax in a slurry reactor one also shifts the wax to condensate mass ratio higher (62:38) producing more wax having higher average carbon numbers (peaking around $C_{30}$), with a longer tail (up to $C_{120}$) on the Schultz-Flory distribution, in comparison to traditional Co slurry processes with wax to condensate mass ratio roughly 50:50 over the lifetime of the catalyst and the wax peaking at around $C_{21}$.

The Fischer-Tropsch wax is typically recovered from a side of a Fischer-Tropsch slurry reactor and is thus preferably produced using an iron-based Fischer-Tropsch catalyst under the conditions shown in Table 1, producing wax with an alpha value of about 0.945 and ranging up to about $C_{120}$. The Fischer-Tropsch wax contains mostly linear paraffins in said range of about $C_{15}$-$C_{120}$.

In the vacuum distillation column 110, the Fischer-Tropsch wax is separated into a light $C_{15}$-$C_{22}$ fraction, an intermediate $C_{23}$-$C_{50}$ fraction withdrawn by means of a flow line 128 and a $C_{50}^{+}$ heavier fraction withdrawn by means of a flow line 130.

The $C_{15}$-$C_{22}$ light fraction is mainly paraffinic and is combined with the $C_{16}$-$C_{22}$ heavy fraction in flow line 94 of the process 20 for dehydrogenation in the dehydrogenation stage 58 of the process 20 to produce more internal olefins.

The $C_{23}$-$C_{50}$ intermediate fraction is in the lubricant base oil range and is passed to the optional hydro-treating stage 112 to remove any small amounts of oxygenates or olefins that may be present in the intermediate fraction. The hydro-treating stage 112 may employ a hydro-treating catalyst which can be any mono-functional commercial catalyst, e.g. Ni on alumina.

The hydro-treated intermediate fraction is withdrawn from the hydro-treating stage 112 by means of a flow line 132 and fed to the hydro-isomerisation stage 114 where the $C_{23}$-$C_{50}$ intermediate fraction is reacted over preferably a noble metal catalyst on SAPO-11, ZSM-22, ZSM-48, ZBM-30 or MCM-type support, to provide a hydro-isomerised intermediate product. The hydro-isomerised intermediate product is withdrawn by means of a flow line 134 and separated in the vacuum distillation column 116 into three lubricant base oil grades or fractions, namely a light grade base oil fraction withdrawn by means of a flow line 136, a medium grade base oil fraction withdrawn by means of a flow line 138 and a heavy base oil fraction withdrawn by means of a flow line 140.

The $C_{50}^{+}$ heavier fraction from the vacuum distillation column 110 is subjected to hydro-treatment in the optional hydro-treating stage 118, if necessary, to remove any small amounts of oxygenates or olefins that may be present in the $C_{50}^{+}$ heavier fraction, before being passed by means of a flow line 142 to the hydro-cracking stage 120. The hydro-cracking stage 120 employs a hydro-cracking catalyst which is preferably a noble metal-based catalyst on either an amorphous $SiO_2/Al_2O_3$ support or a Y-zeolite. The hydro-cracking stage is preferably run under conditions of high severity such that at least 80% by mass of components of the $C_{50}^{+}$ heavier fraction boiling above 590° C. are converted or cracked to form components boiling at less than 590° C. Care must however be taken to avoid over-cracking to provide a distillate selectivity of $C_{12}$-$C_{22}$ hydrocarbons that is still above 75% with the pour point for such a distillate being less than −15° C. EP 1421157 gives a good description of what could be achieved under high severity noble metal hydrocracking conditions.

A cracked intermediate is thus withdrawn from the hydro-cracking stage 120 by means of a flow line 144 and passed to the atmospheric distillation column 122.

The hydro-isomerised intermediate product from the hydro-isomerisation stage 114 may include naphtha and other components lighter than $C_{22}$, depending on the severity of the hydro-isomerisation process. The distillation column 116 may thus produce a distillate lighter than $C_{22}$ which may be combined with the cracked intermediate in flow line 144.

In the atmospheric distillation column 122, the cracked intermediate is separated into a light fraction for producing liquefied petroleum gas (LPG), as shown by flow line 146, a naphtha fraction withdrawn by means of a flow line 148, a heavier than naphtha paraffinic distillate fraction withdrawn by means of a flow line 150, and a bottoms fraction which is heavier than the paraffinic distillate fraction and which is withdrawn by means of a flow line 152.

The light LPG fraction withdrawn by means of the flow line 146 can be used in the process 20 in the form of liquefied petroleum gas as represented by flow line 70.

The naphtha fraction, which is typically a $C_5$-$C_{11}$ fraction, has relatively little value. The naphtha fraction in flow line 148 can be used as diluent, e.g. to improve pumpability of any high viscosity material produced in the process 10, or as feedstock to a steam cracker. Alternatively, the naphtha fraction can be combined with the intermediate fraction in flow line 82 from the distillation column 42 of the process 20.

The heavier than naphtha paraffinic distillate fraction from the atmospheric distillation column 122 can be used as a synthetic paraffinic drilling fluid component having better profit-contributing margins than diesel. In order to ensure that the distillate fraction has a flash point above 60° C., a bottom cut point of the heavier than naphtha paraffinic distillate fraction is set around $C_{12}$ or higher in the atmospheric distillation column 122, rather than the traditional $C_9$ as is the norm for diesel. The pour point of the paraffinic distillate fraction is at a good value for drilling fluids (less than −15° C.) with a high percentage of branched paraffinic molecules (greater than 30% by mass i:n paraffin ratio) due to the use of the noble metal hydro-cracking catalyst run at high severity in the hydro-cracking stage 120. If the desired pour point for certain applications needs to be below −25° C. the $C_{12}$-$C_{22}$ paraffinic distillate fraction or drilling fluid could be further hydro-isomerised with a similar noble metal catalyst as was mentioned for the hydro-isomerisation stage 114, producing a highly branched product which would then typically have an i:n paraffin mass ratio greater than 2:1. The $C_{12}$-$C_{22}$ paraffinic distillate fraction has less than 1% by mass aromatics, which is of importance from an eco-toxicity and biodegradability perspective.

The bottoms fraction, typically $C_{22}$+ can be recycled by means of the flow line 152 to the hydro-cracking stage 120. Alternatively, and preferably, the bottoms fraction is however fed to the hydro-isomerisation stage 114 to produce more high valuable base oils with profit margins considerably higher than those of drilling fluids.

Figure 2:
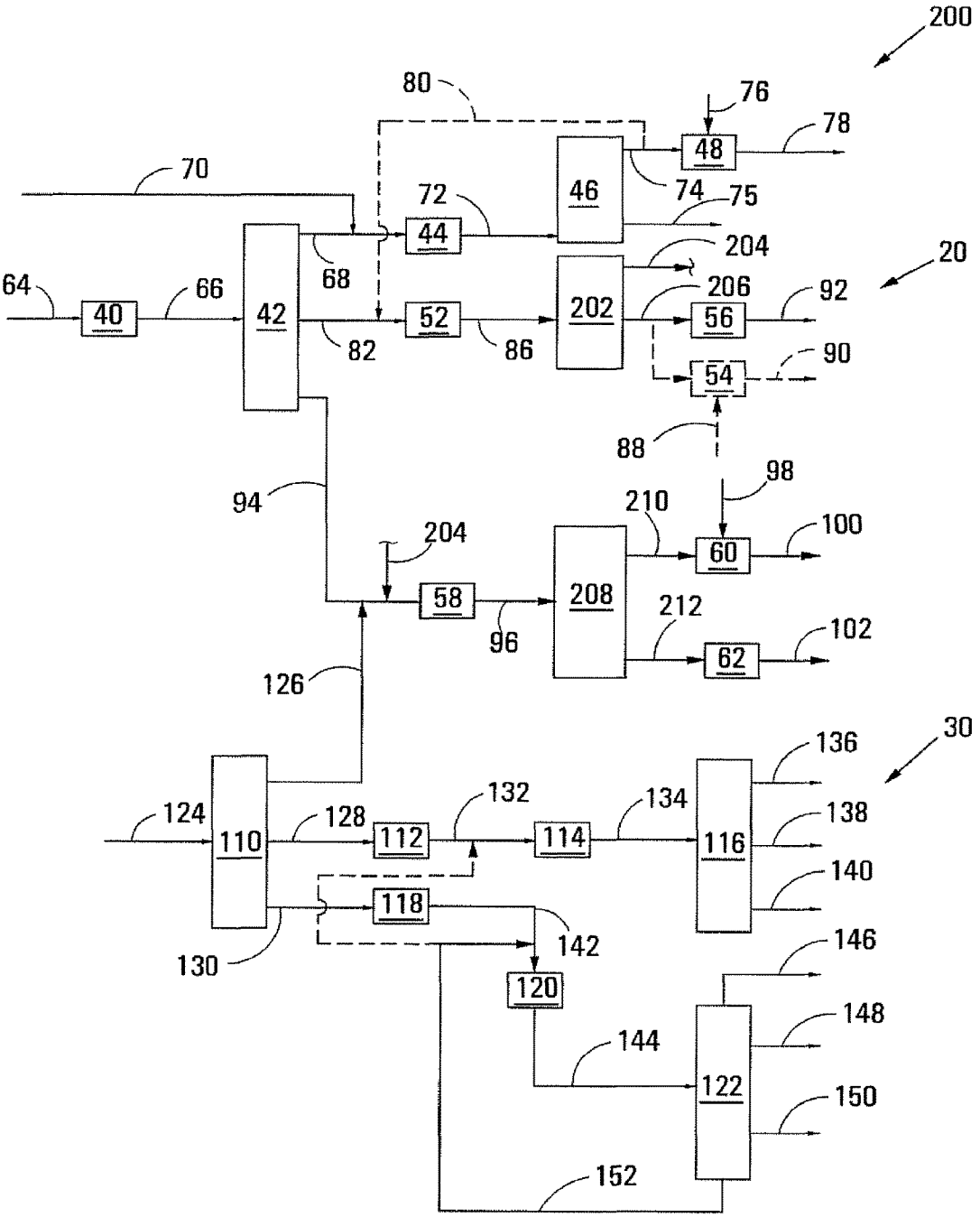
FIG. 2 shows a portion of a process in accordance with a second embodiment of the invention, to produce olefinic products suitable for use as or conversion to oilfield hydrocarbons and to produce paraffinic products suitable for use as or conversion to oilfield hydrocarbons, together with base oils.

Referring to FIG. 2, reference numeral 200 generally indicates a portion of a process in accordance with a second embodiment of the invention to produce olefinic products suitable for use as or conversion to oilfield hydrocarbons and to produce paraffinic products suitable for use as or conversion to oilfield hydrocarbons, as well as base oils.

Parts of the process 200 which are the same or similar to those of the process 10 of FIG. 1, are indicated with the same reference numerals.

The process 200 differs from the process 10 of FIG. 1 as regards its process 20, and more particularly as regards the workup of its intermediate $C_8$-$C_{15}$ fraction and its heavy $C_{16}$-$C_{22}$ fraction emanating from the distillation column 42.

In the process 200, the $C_8$-$C_{15}$ intermediate fraction passes, by means of the flow line 82, directly to the dimerisation stage 52, that is, the dehydrogenation stage 50 of the process 10 is dispensed with. In the dimerisation stage 52, alpha olefins in the intermediate fraction are dimerised. The product from the dimerisation stage 52 passes along the flow line 86 into a fractionation column 202. The fractionation column 202 separates the product from the stage 52 into a $C_8$-$C_{15}$ paraffin fraction, which is withdrawn along a flow line 204, and a $C_{16}$-$C_{22}$ olefin stream that passes, along a flow line 206, into the hydroformylation and alkoxylation stage 56. Optionally, but less preferably, the $C_{16}$-$C_{22}$ olefin stream from the fractionation column 202 can be routed to the aromatic alkylation stage 54.

The $C_8$-$C_{15}$ paraffin stream from the fractionation column 202 passes, by means of the flow line 204, to the flow line 94 so that this fraction is also subjected to dehydrogenation in the dehydrogenation stage 58. The product from the dehydrogenation stage 58 passes, by means of the flow line 96, into a fractionation column 208, where it is separated out into a $C_8$-$C_{15}$ internal olefin fraction and a $C_{16}$-$C_{22}$ internal olefin fraction. The $C_8$-$C_{15}$ internal olefin fraction is withdrawn from the column 208 along a flow line 210 and passes into the aromatic alkylation stage 60. The $C_{16}$-$C_{22}$ internal olefin fraction passes from the column 208, along a flow line 212, into the hydroformylation and alkoxylation stage 62, where alkoxylated alcohols are produced.

When the process 200 is compared with the process 10 of FIG. 1, it will be noted that the dehydrogenation stage 50 and the optional intermediate fraction separation stage of the process 10, are, in effect, replaced by the two fractionation columns 202, 208.

It will be appreciated that the flow lines 75, 206 and 212 can all feed into a single hydroformylation and alkoxylation stage, say the hydroformylation and alkoxylation stage 56, which will result in a substantial reduction in capital and operating costs. Similarly, the flow lines 74 and 210 can lead into a single aromatic alkylation stage, say the aromatic alkylation stage 48, which will also result in savings in capital and operating costs.

The products obtained from the single hydroformylation/alkoxylation unit would be a mixture of linear and branched alkoxylated alcohols, while the product from the single aromatic alkylation unit would be a mixture of linear and branched di-alkylates. More specifically, the $C_{15}^+$ olefin stream withdrawn from the distillation column 46 along the flow line 75 would produce branched oligomerised alcohols, while the $C_{16}$-$C_{22}$ olefin stream withdrawn from the fractionation column 202 along the flow line 206, and comprising mainly vinylidene olefins, would also produce branched alcohols. The $C_{16}$-$C_{22}$ internal olefin fraction withdrawn from the fractionation column 208 along the flow line 212 would produce linear alcohols. The $C_9$-$C_{15}$ olefin stream withdrawn from the distillation column 46 along the flow line 74, and comprising mainly branched oligomerised olefins, produces branched di-alkylates, while the $C_8$-$C_{15}$ internal olefin fraction withdrawn from the fractionation column 208 along the flow line 210, and comprising mainly internal olefins, produce linear di-alkylates.

However, if it is desired to produce mono-alkylates in preference to di-alkylates, then one could retain stages 54 and/or 60 as separate stages.

As will be appreciated, by means of the process 30, a Fischer-Tropsch wax has through various hydro-processing steps been upgraded to higher value paraffins that can be used in oilfield hydrocarbons, for example as surfactants or solvents or drilling fluids, for on-shore or off-shore drilling operations, in the $C_{12}$-$C_{22}$ carbon range, and to produce various valuable base oil fractions boiling in the $C_{22}$-$C_{50}$ carbon range.

Advantageously, the processes 10, 200 provide a total yield of olefins in the $C_{16}$-$C_{30}$ carbon range exceeding 25% by mass, possibly even 30% by mass. The yield of total paraffins exceeds 25% by mass with the lubricant base oil fractions exceeding 15% by mass and the yield of paraffinic drilling fluid exceeding 10% by mass, producing more than 50% by mass valuable oilfield and base oil hydrocarbons from a single Fischer-Tropsch synthesis facility. The balance of the syncrude not mentioned in Table 2 and not converted to valuable oilfield hydrocarbons or base oils could be a small percentage of lower paraffins ($C_3$-$C_7$) and Fischer-Tropsch reactor tail gas, e.g. $CH_4$, $C_2H_4$, $C_2H_6$ as well as a $C_1$-$C_5$ aqueous product.

Whereas refining of hydrocarbon streams, e.g. from a Fischer-Tropsch synthesis process, conventionally targeted a $C_5$-$C_9$ naphtha fraction, a $C_9$-$C_{15}$ jet fuel fraction, a $C_9$-$C_{22}$ diesel fraction and a $C_{22}$-$C_{40}$ base oil fraction, the present invention, as illustrated, attempts to maximise olefin production and targets a $C_{16}$-$C_{30}$ olefins fraction and various other olefinic and paraffinic fractions and base oil grades, different from the conventional fractions, with a view to improving profit margins and to supply the demand for oilfield hydrocarbons and lubricant base oils cost-effectively.

The invention claimed is:

1. A process to produce paraffinic products for use as or conversion to oilfield hydrocarbons and to produce lubricant base oils, the process including separating a Fischer-Tropsch wax into a light fraction and a $C_{23}$-$C_{50}$ intermediate fraction and a $C_{50}$+ heavier fraction;

hydro-isomerising the $C_{23}$-$C_{50}$ intermediate fraction using a hydro-isomerisation catalyst to provide a hydro-isomerised intermediate product;

separating the hydro-isomerised intermediate product into two or more base oil fractions;

hydrocracking the heavier fraction to provide a cracked intermediate; and separating the cracked intermediate into at least a naphtha fraction, a heavier than naphtha paraffinic distillate fraction comprising at least 50% by mass of hydrocarbons having chain lengths between 12 and 22 carbon atoms per molecule for use as or conversion to oilfield hydrocarbons, and a bottoms fraction which is heavier than the paraffinic distillate fraction.

2. The process according to claim 1, in which the cracked intermediate is separated also into a light or LPG fraction which is lighter than the naphtha fraction.

3. The process according to claim 1, in which the heavier fraction is cracked using a noble metal based catalyst on either an amorphous $SiO_2/Al_2O_3$ support or a Y-zeolite under conditions of high severity such that at least 80% by mass of components of the $C_{50}$+ heavier fraction boiling above 590° C. are converted or cracked to form components boiling at less than 590° C.

4. The process according to claim 3, in which the cracked intermediate is separated by distillation such that at least 75% by mass of the heavier than naphtha paraffinic distillate fraction is made up of hydrocarbons having carbon chain lengths of between 12 and 22 carbon atoms per molecule and having at least 0.5 branches per molecule on average, or in which at least 90% by mass of the heavier than naphtha paraffinic distillate fraction is made up of hydrocarbons having carbon chain lengths of between 12 and 22 carbon atoms per molecule and having at least 0.5 branches per molecule on average.

5. The process according to claim 3, in which the cracked intermediate is separated by distillation such that at least 95% by mass of molecules making up the paraffinic distillate fraction boils between 200° C. and 370° C.

6. The process according to claim 3, in which the cracked intermediate is separated by distillation such that the paraffinic distillate fraction has a flash point above 60° C., and/or such that the paraffinic distillate fraction has a pour point of less than −15° C., and/or such that the paraffinic distillate fraction has an i:n-paraffin ratio greater than 50% by mass.

7. The process according to claim 1, which includes hydro-isomerising the paraffinic distillate fraction using a noble metal hydro-isomerisation catalyst to reduce the pour point of the paraffinic distillate fraction.

8. The process according to claim 1, in which the light fraction is a $C_{15}$-$C_{22}$ light fraction.

9. The process according to claim 1, which includes hydrotreating the intermediate fraction using a hydrotreating catalyst to remove oxygenates or olefins that may be present.

10. The process according to claim 1, in which the hydro-isomerised intermediate product is vacuum-distilled into at least a light grade base oil fraction, a medium grade base oil fraction and a heavy base oil fraction.

11. The process according claim 1, in which separating the hydro-isomerised intermediate product includes producing a naphtha fraction and/or a $C_{12}$-$C_{22}$ distillate fraction, depending on the severity of the hydro-isomerisation process step and, when a $C_{12}$-$C_{22}$ distillate fraction is produced, joining the $C_{12}$-$C_{22}$ distillate fraction with the cracked intermediate, or separating the $C_{12}$-$C_{22}$ distillate fraction with the cracked intermediate, to provide additional paraffinic distillate fraction.

12. The process according to claim 1, in which the cracked intermediate is separated by distillation such that at least 95% by mass of molecules making up the bottoms fraction obtained from the cracked intermediate boils above 370° C.

13. The process according to claim 1, in which the bottoms fraction obtained from the cracked intermediate is subjected to hydro-isomerisation together with the intermediate fraction obtained from the Fischer-Tropsch wax to increase valuable base oil production.

14. The process according to claim 1, which includes subjecting synthesis gas to Fischer-Tropsch synthesis in a Fischer-Tropsch synthesis stage to produce said Fischer-Tropsch wax, the Fischer-Tropsch synthesis stage employing at least one slurry reactor using an Fe-based Fischer-Tropsch catalyst to convert synthesis gas to hydrocarbons, the Fischer-Tropsch synthesis stage being operated at a temperature between 200° C. and 300° C. at a pressure between 15 bar(a) and 40 bar(a) with a synthesis gas $H_2$:CO molar ratio between 0.7:1 and 2:1 and with a wax alpha value of at least 0.92.

* * * * *